United States Patent [19]

Bentz et al.

[11] 4,032,254

[45] June 28, 1977

[54] REVERSIBLE CROSS FLOW BLOWER

[75] Inventors: Erwin John H. Bentz, Washington; Paul Julius Staebler, Dunlap, both of Ill.

[73] Assignee: Caterpillar Tractor Co., Peoria, Ill.

[22] Filed: Oct. 20, 1975

[21] Appl. No.: 623,888

[52] U.S. Cl. ..... 415/54; 415/126; 415/152 R

[51] Int. Cl.[2] ..... F04D 5/00

[58] Field of Search ..... 415/54, 126, 160; 417/423 R; 115/16, 151; 60/221

[56] References Cited

UNITED STATES PATENTS

| | | | |
|---|---|---|---|
| 2,214,656 | 9/1940 | Briggs | 115/151 |
| 3,116,011 | 12/1963 | Laing | 415/126 |
| 3,117,715 | 1/1964 | Bloomingdale | 417/362 |
| 3,150,815 | 9/1964 | Laing | 415/126 |
| 3,275,224 | 9/1966 | Bush | 415/126 |
| 3,598,078 | 8/1971 | Baer | 115/151 |
| 3,650,633 | 3/1972 | Benoit | 417/423 R |
| 3,801,216 | 4/1974 | Holzhauer et al. | 415/160 |

FOREIGN PATENTS OR APPLICATIONS

| | | | |
|---|---|---|---|
| 610,021 | 5/1926 | France | 415/126 |
| 1,143,083 | 4/1957 | France | 415/126 |
| 337,300 | 5/1959 | Switzerland | 415/54 |
| 207,834 | 7/1968 | U.S.S.R. | 415/126 |
| 189,506 | 1/1967 | U.S.S.R. | 415/54 |

*Primary Examiner*—Henry F. Raduazo
*Attorney, Agent, or Firm*—Phillips, Moore, Weissenberger, Lempio & Majestic

[57] ABSTRACT

Reversal means for a transverse or cross flow blower is provided which allows for reversal of fluid flow direction without changing impeller rotation direction. In the first embodiment, power means rotate the housing 180° from its initial position, thereby providing for reversal of the fluid flow. In the second embodiment, fluid flow reversal is provided by a pair of inlet and outlet volute walls made up of curved vanes. The vanes are generally elongated and pivotally mounted for rotation about their longitudinal axis by means of linkages connected to a power means. By opening the vanes of one volute wall while closing the vanes of the other, air flow reversal is conveniently accomplished.

7 Claims, 6 Drawing Figures

REVERSIBLE CROSS FLOW BLOWER

BACKGROUND OF THE INVENTION

This invention relates to transverse or cross flow blowers. More particularly, this invention relates to a reversing means for accomplishing flow reversal of the working fluid, e.g. air, in such blowers without the necessity of reversing the impeller direction.

Transverse or cross flow blowers typically have a drum type impeller with forward, curved blades mounted thereon. The impeller, or rotor, is closed at both ends and mounted on a shaft. By rotating the shaft within a housing having an inlet, an outlet, and directing walls, air or other working fluid is pulled in through the inlet across the impeller and is expelled through the outlet. Research in the early 1950's, primarily in Germany, led to the discovery that flow within the impeller itself is characterized by the formation of a vortex which is eccentric to the axis of rotation of the impeller. This vortex is controlled by the shape and position of the shroud or wall adjacent the impeller. The vortex may be thought of as a seal which prevents flow carried around in the direction of rotation of the impeller from being returned to the inlet.

Transverse or cross flow fans or blowers have been found to be extremely useful, and have replaced axial flow fans or blowers in numerous applications. They have the advantage of being relatively thin, and are therefore suitable for use in confined spaces such as in refrigerated food display cases and domestic refrigerators. One disadvantage that these cross flow blowers possess is the inability to achieve fluid flow reversal in a practical manner. If flow reversal of the conventional cross flow blower is to be achieved, one approach is to merely reverse the direction of rotation of a motor driving the impeller. However, this is not satisfactory since the impeller blades are curved in the forward flow direction. Another approach would be to manually remove the impeller and turn it end for end while at the same time reversing the motor rotation direction. However, this is a time consuming and laborious task and does not allow for quick changes of flow direction required in certain applications.

One of the applications where such transverse flow fans or blowers are desired to be used is in the earth-moving and material handling equipment field. Here, engines are typically cooled by means of water cooling systems which utilize radiators. A transverse flow blower may be used to augment the cooling of a radiator. However, in the dust filled environment in which this type of equipment operates, the radiator cores frequently become clogged with dirt and consequently the cooling effect reduced to a dangerously low level. At this point the radiator core must be cleaned, usually by hand.

The present invention provides a reversing means for reversing a transverse cross flow blower without the necessity of reversing impeller rotation direction. Thus, if a radiator core with which the blower is used is clogged with dirt, it may be easily cleaned when flow direction is reversed. The invention includes the use of power means for rotating the blower housing 180° so that the flow direction is reversed by reversing inlet and outlet positions. In an alternate embodiment, louvers or vanes which form a shroud or volute wall adajcent the impeller are moved so as to change the vortex flow characteristics of the impeller and thereby accomplish flow reversal without the necessity of reversing the impeller direction itself.

OBJECTS OF THE INVENTION

It is therefore the primary object of this invention to provide a means for accomplishing flow reversal of a transverse or cross flow blower without the necessity of reversing impeller direction.

It is a further object of this invention to provide a transverse flow blower wherein the flow may be quickly and easily reversed.

Further and other objects of this invention will become more readily apparent from a review of the following description and accompanying drawings.

DETAILED DESCRIPTION

Figure 1:
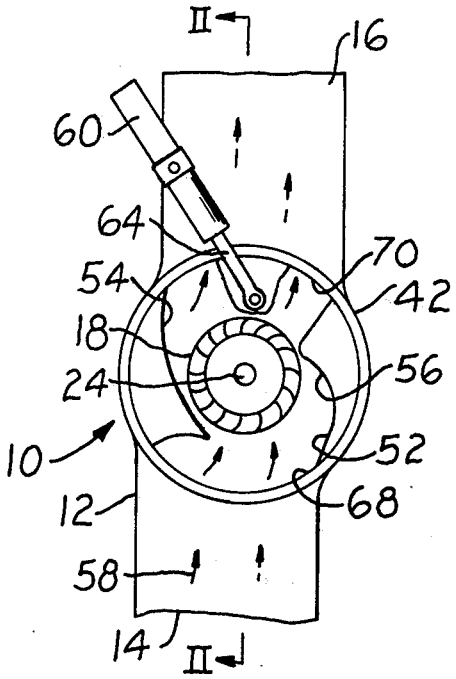
FIG. 1 is an end elevation view of a transverse flow blower of the instant invention with housing cover partially cut away to show flow details.
Figure 2:
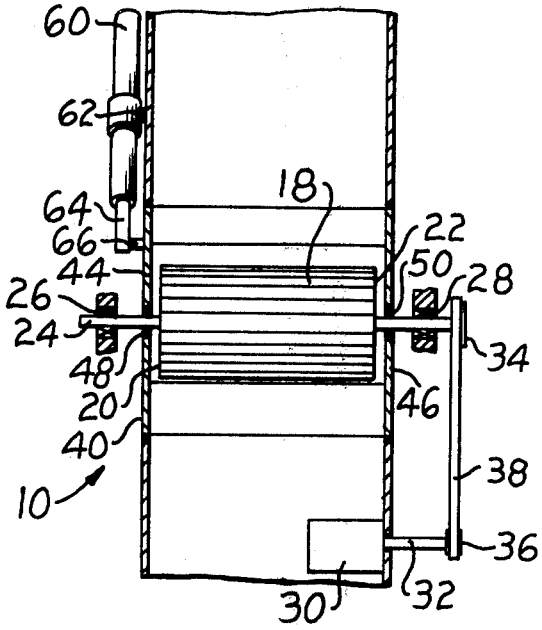
FIG. 2 is a view taken along the lines II—II in FIG. 1.

Turning now to FIG. 1, there is shown generally at 10 a transverse flow fan of the instant invention having a closed housing 12 and an open inlet 14 and outlet 16. As seen in FIG. 2, a generally drum shaped impeller 18 having a pair of disks 20, 22 closing off opposite ends thereof is mounted within the housing. Impeller 18 is mounted on a shaft 24 which is mounted on bearings 26, 28. The shaft and impeller are driven by an electric motor 30 which drives the shaft 32. A pair of pulleys 34, 36 are interconnected for rotation by a belt 38. A reversing mechanism in the form of a drum shaped housing 40 having generally cylindrical sidewalls 42 and defining an interior space closed by disk ends 44, 46 is provided. The housing 40 is rotatably mounted with respect to and on shaft 24 by means of bearings 48, 50 in the centers thereof.

As seen in FIG. 1, the interior space of the housing is divided up by a pair of volute walls or shrouds 52, 54. As shown in the figure, these walls serve to create a vortex 56 asymmetric of the shaft 24, and, as the impeller rotates, it creates a flow of air or other working fluid in the arrow direction 58.

As seen in the figures, the reversing mechanism also includes a power means such as hydraulic cylinder 60 mounted on pivot 62. The rod end 64 of cylinder 60 is in turn connected to a pivot 66 on disk 44. Inlet and outlet openings 68, 70 in drum 40 permit airflow to pass therethrough.

Figure 3:
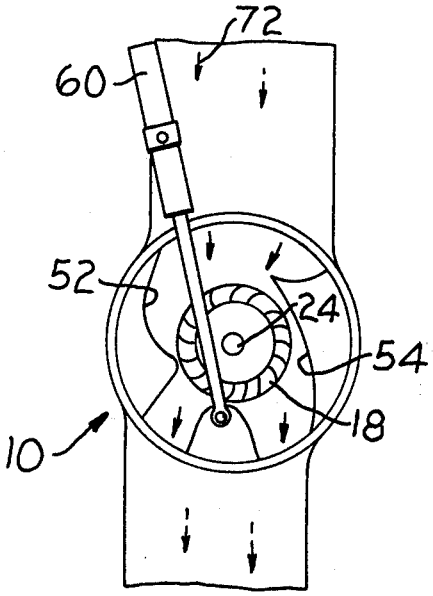
FIG. 3 is a view similar to FIG. 1 showing the housing advanced 180° so as to change the flow direction.

When it is desired to change the airflow direction the hydraulic cylinder is actuated by control means (not shown) leading from a source of fluid pressure (not shown) so as to rotate the drum 40 180° to the position shown in FIG. 3. In this manner, vortex 56 created by the rotation of impeller 18 transfers to the opposite side of shaft 24 when airflow is reversed to assume direction 72. Airflow can then again be reversed by merely reactuating cylinder 60 to again rotate drum 40. Thus is provided a simple and effective means for reversing airflow direction in a transverse or crossflow blower.

Figure 4:
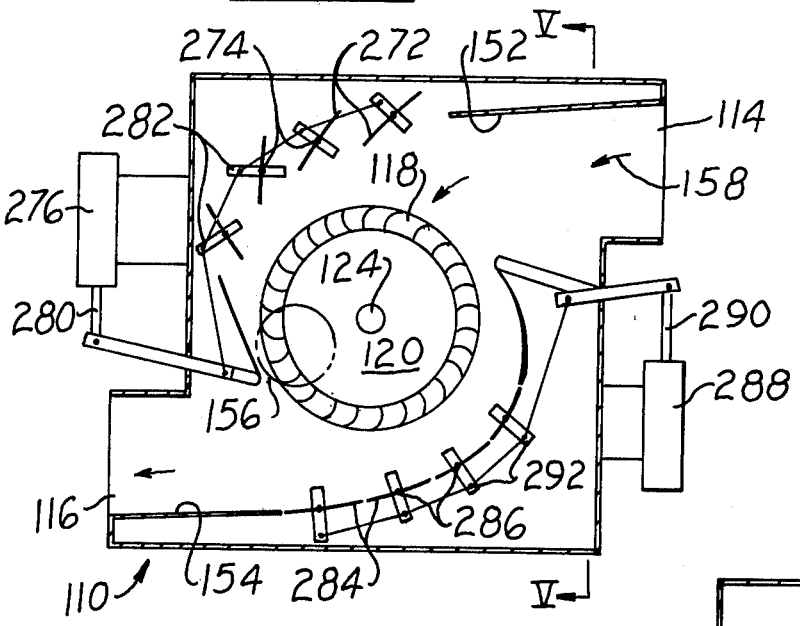
FIG. 4 is a view similar to FIG. 1 of an alternate embodiment of the invention with the housing cover partially cut away to show flow direction and details of the flow reversing mechanism.
Figure 5:
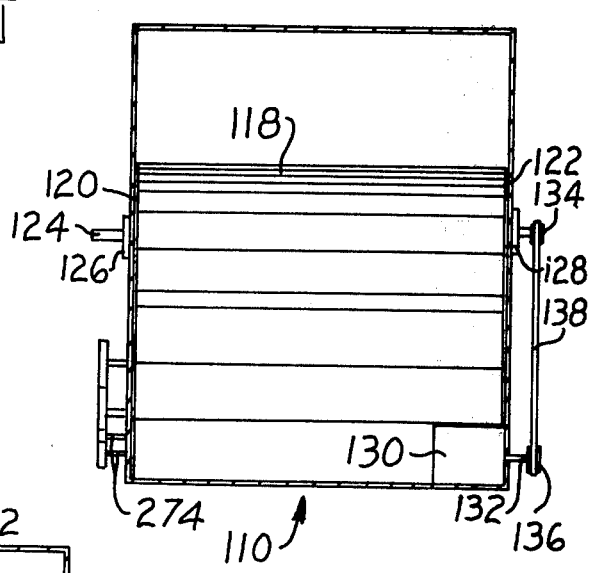
FIG. 5 is a view taken along the lines V—V in FIG. 4.
Figure 6:
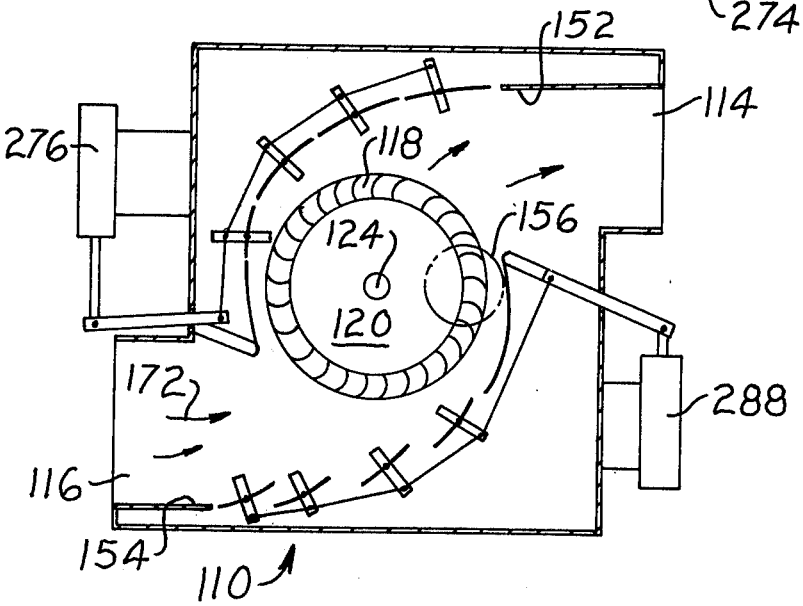
FIG. 6 is a view similar to FIG. 4 showing flow reversal.

Turning to FIGS. 4–6, there is shown an alternate embodiment wherein the flow of a crossflow blower can be reversed. It should be understood that in the following discussion elements having their counterpart in the primary embodiment are signified by the placement of a 1 before the element designation. With this system, the housing generally shown at 110 is generally rectangularly shaped and defines an inlet opening 114 and an outlet opening 116 on opposite sides thereof. As seen in FIG. 5, an impeller 118 having transverse vanes thereon is mounted on a shaft 120 for a means of bearings 126, 128 mounted on the sides of a housing. As seen in FIG. 4, the vortex 156 is formed adjacent asymmetric with shaft 124 by means of volute walls or shrouds 152, 154. As seen in FIG. 4, the inlet volute wall is made up in part by a plurality of longitudinal vanes 272 pivotally mounted on their longitudinal axes by pivots 274 so as to permit the admission of inlet air through inlet opening 114 and thereby create the vortex 156 at the position shown. Actuation of the vanes may be achieved by use of hydraulic cylinder 276 having its rod end 280 connected to the pivots 274 by a plurality of linkages 282 pivotally connected thereto. Similarly, outlet vortex wall or shroud 154 is also comprised of a plurality of vanes 284 pivotally mounted by means of pivots 286 and connected to a power means such as hydraulic cylinder 288 having a rod 290 and linkages 292.

In operation, when it is desired to change airflow direction from direction 158 as shown in FIG. 4 to direction 172 as shown in FIG. 6, cylinders 276, 288 are actuated so as to close inlet wall 152 and open outlet wall 154. In this manner vortex 156 is transferred to the right side of shaft 124 and airflow is reversed. Thus, the airflow in the subject embodiment is reversed by opening one set of volute wall louvers or vanes and closing the other.

It is to be understood that the foregoing description is merely illustrative of a preferred embodiment of the invention, and that the scope of the invention is not to be limited thereto but is to be determined by the scope of the appended claims.

What is claimed is:

1. In a transverse flow blower having a housing defining an inlet and an outlet, a drum shaped impeller having a plurality of curved blades mounted thereon, said housing comprising a generally rectangular duct having inlet and outlet ends and a housing drum, said housing drum defined by a pair of cylindrically shaped side wall portions joined by a pair of disks so as to define an interior space enclosing said impeller, means rotatably mounting said impeller with respect to said housing so that rotation thereof causes flow of fluid from said inlet to said outlet, said means for rotatably mounting said impeller comprising an elongated shaft and support bearings, and bearings on said shafts rotatably mounting said housing drum relative to said inlet and outlet ends whereby rotation of said housing drum approximately 180° causes said shrouds to be repositioned approximately 180° for fluid flow reversal, means in said housing drum defining volute walls comprising a pair of curved shrouds, each one of said shrouds being mounted on a respective one of said of cylindrically shaped sidewalls and means for reversing the direction of fluid flow while maintaining the direction of rotation of said impeller, said means comprising power means for rotating the housing drum and thereby said volute walls approximately 180°, said power means comprising a hydraulic cylinder attached to one of said ends and a rod actuator connected to said housing drum for selective rotation thereof about said shaft by said power means.

2. In a transverse flow blower having a housing defining an inlet and an outlet, a drum shaped impeller having a plurality of curved blades mounted therein, means rotatably mounting said impeller with respect to said housing so that rotation thereof causes flow of fluid from said inlet to said outlet, means in said housing defining a pair of volute walls, said volute walls comprising an inlet and an outlet wall wherein the improvement comprises means for reversing the direction of fluid flow while maintaining the direction of rotation of said impeller, each of said inlet and outlet walls being formed by a plurality of separate and distinct vanes, and wherein said means for reversing fluid flow comprises means for selectively opening said vanes of one of said volute walls and closing said vanes of the other of said volute walls.

3. The invention of claim 2 wherein said means for opening and closing said vanes comprises linkage means interconnecting the inlet and outlet vanes for respective movement.

4. The invention of claim 3 wherein said vanes are each mounted on a pivot defining a longitudinal axis, and wherein said linkage means comprises linkages interconnecting said pivots for rotation thereof.

5. The invention of claim 4 wherein said means for opening and closing comprises power means for actuating said linkages and thereby said vanes.

6. The invention of claim 5 wherein said power means comprises a hydraulic cylinder.

7. The invention of claim 2 further including motor means on said housing for rotating said impeller.

* * * * *